United States Patent [19]

Nagano

[11] 4,147,141

[45] Apr. 3, 1979

[54] EXHAUST GAS RECIRCULATION SYSTEM IN AN INTERNAL COMBUSTION ENGINE

[75] Inventor: Tetsuro Nagano, Susono, Japan

[73] Assignee: Toyota Jidosha Kogyo Kabushiki Kaisha, Toyota, Japan

[21] Appl. No.: 849,353

[22] Filed: Nov. 7, 1977

[30] Foreign Application Priority Data

Jul. 22, 1977 [JP] Japan ..... 52/87264

[51] Int. Cl.[2] ..... F02M 25/06

[52] U.S. Cl. ..... 123/119 A; 60/320

[58] Field of Search ..... 123/119 A; 60/320, 278, 60/279

[56] References Cited

U.S. PATENT DOCUMENTS

| | | | |
|---|---|---|---|
| 2,977,940 | 4/1961 | Theriault | 123/119 A |
| 3,223,150 | 12/1965 | Tramontini | 60/320 |
| 3,282,046 | 11/1966 | Walker et al. | 60/320 |
| 3,357,413 | 12/1967 | Quinton | 60/320 |
| 3,621,825 | 11/1971 | Osala | 123/119 A |
| 3,645,098 | 2/1972 | Templin et al. | 123/119 A |
| 3,817,221 | 6/1974 | Nohira et al. | 123/119 A |
| 3,915,133 | 10/1975 | Nohira | 123/119 A |
| 3,941,105 | 3/1976 | Yagi | 123/119 A |
| 4,055,158 | 10/1977 | Marsee | 123/119 A |
| 4,075,994 | 2/1978 | Mayer | 123/119 A |

*Primary Examiner*—Wendell E. Burns

*Attorney, Agent, or Firm*—Stevens, Davis, Miller & Mosher

[57] ABSTRACT

This application discloses an exhaust gas recirculation system in an internal combustion engine. The system comprises:

an EGR pipe which interconnects an exhaust pipe and an intake pipe of the engine;

an EGR valve mounted on said EGR pipe;

an EGR cooler mounted on said EGR pipe upstream of said EGR valve;

a by-pass pipe arranged parallel to said EGR cooler;

a thermosensor which detects the EGR gas temperature; and, a selection valve arranged at the connection point of said by-pass pipe to said EGR pipe, said selection valve co-operating with said thermosensor so that when the EGR gas temperature is low, the EGR gas passes through said by-pass pipe.

4 Claims, 3 Drawing Figures

EXHAUST GAS RECIRCULATION SYSTEM IN AN INTERNAL COMBUSTION ENGINE

BACKGROUND OF THE INVENTION

The present invention relates to an improvement of an exhaust gas recirculation (EGR) system in an internal combustion engine for reducing $NO_x$ emissions in the exhaust gas.

In the known EGR system, a part of the exhaust gas is recirculated into the combustion chamber of the engine in order to lower the maximum combustion temperature so as to reduce $NO_x$ emission production. Such an EGR system comprises an EGR pipe which interconnects an exhaust pipe and an intake pipe of the engine, and an EGR valve mounted on the EGR pipe. The EGR valve operates in response to the engine temperature, vehicle speed, throttle valve opening or any other factors which indicate the driving condition of the vehicle, so as to control the EGR amount. An EGR cooler is arranged on the EGR pipe upstream of the EGR valve in order to avoid thermal damage to the EGR valve by exhaust gas of high temperature and to heighten the effect of the EGR system. However, in the light-loaded condition of the engine, that is, when the EGR amount is small, the EGR gas is over-cooled to or below 250° C. This results in carbon accumulating and acid water condensing on the EGR valve and EGR pipe, causing the EGR ejection port to be clogged and the characteristic of the EGR valve to change. As a result, the known EGR system does not work satisfactorily and the desired EGR amount is not attained.

SUMMARY OF THE INVENTION

It is an object of the present invention to obviate the above mentioned drawbacks due to the carbon accumulation and the condensation of the acid water in the EGR system which comprises an EGR cooler. An EGR system according to the invention comprises: an EGR pipe which interconnects an exhaust pipe and an intake pipe of the engine; an EGR valve mounted on said EGR pipe; an EGR cooler mounted on said EGR pipe upstream of said EGR valve; a by-pass pipe arranged parallel to said EGR cooler; a thermosensor which detects the EGR gas temperature; and, a selection valve arranged at the connection point of said by-pass pipe to said EGR pipe, said selection valve cooperating with said thermosensor so that when the EGR gas temperature is low, the EGR gas passes through said by-pass pipe.

BRIEF DESCRIPTION OF THE APPENDED CLAIMS

The present invention will now be further described with reference to the accompanying drawings in which.

DETAILED DESCRIPTION OF THE PREFERRED EMBODIMENTS OF THE INVENTION

Figure 1:
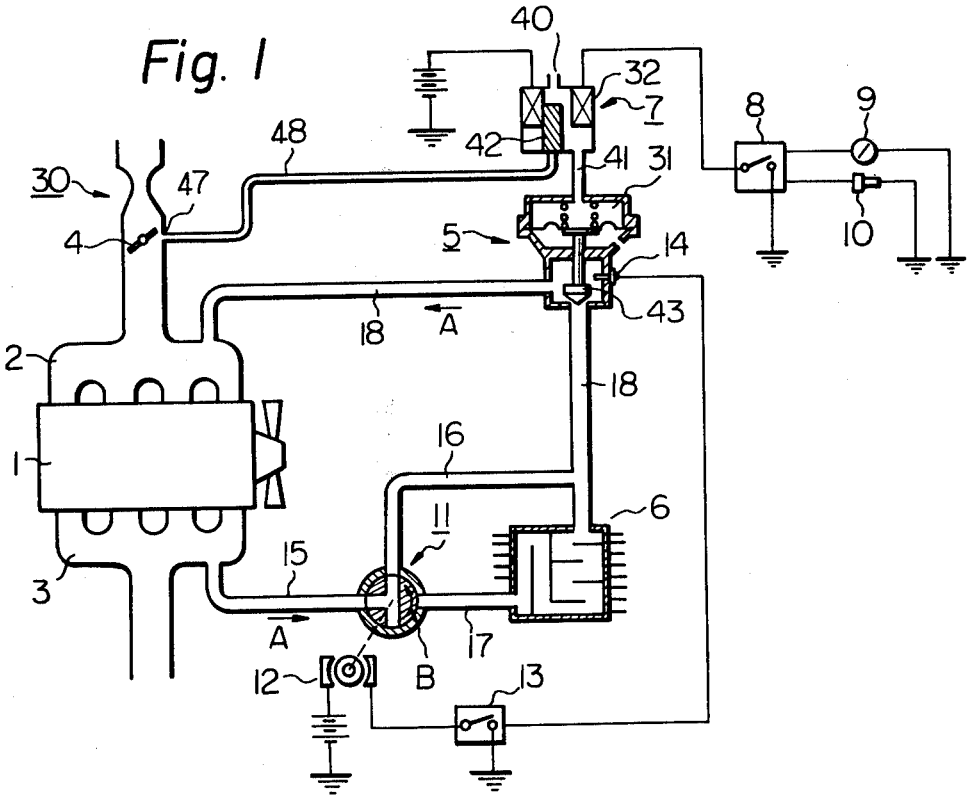
FIG. 1 is a diagrammatical view of an EGR system according to the invention.

In the EGR system illustrated in FIG. 1, an exhaust manifold 3 and an intake manifold 2 of an engine 1 are interconnected by EGR pipes 15, 17 and 18. A diaphragm type EGR valve 5 is mounted on the EGR pipe 18. An EGR cooler 6 is mounted on the EGR pipe 17 upstream of the EGR valve 5. A diaphragm chamber 31 of the EGR valve 5 communicates with an EGR port 47 arranged near a throttle valve 4 of a carburetor 30 through pipes 48 and 41 via a three-way solenoid valve 7, one outlet 40 of which communicates with the atmosphere. A solenoid 32 of the three-way valve 7 is electrically connected to a vehicle speed sensor 9 and a cooling water thermosensor 10 via a control circuit 8. A by-pass pipe 16 is arranged parallel to the EGR cooler 6, one end of the pipe 16 being connected to the EGR pipe 15 and the other end of the pipe 16 being connected to the EGR pipe 18. A selection valve 11 is arranged at the connection point of the by-pass pipe 16 with the EGR pipe 15. The selection valve 11 is of a three-way cock type and actuated by a driving motor 12. The motor 12 is electrically connected to an EGR gas thermosensor 14 arranged on the EGR valve 5 via a control circuit 13.

The above mentioned EGR system operates as follows. When the throttle valve opening increases and the intake vacuum acts upon the EGR port 47, if the speed sensor 9 and the thermosensor 10 detect predetermined values, respectively, the solenoid 32 of the three-way valve 7 is energized by the control circuit 8 so as to move a valve 42 upward in FIG. 1. Therefore, the outlet 40 is closed and the pipes 41 and 48 are communicated with each other so that the intake vacuum is introduced into the diaphragm chamber 31 of the EGR valve 5. Accordingly, a valve 43 of the EGR valve 5 is moved upward so that the EGR gas is recirculated into the intake manifold 2 as is indicated by an arrow A. If the EGR gas temperature which is detected by the thermosensor 14 is below a predetermined value, e.g. below 250° C., the control circuit 13 energizes the driving motor 12 so as to actuate the selection valve 11 so that the EGR pipe 15 is connected to the by-pass pipe 16, which condition is illustrated in FIG. 1. Thus, the EGR gas is recirculated without passing through the EGR cooler 6. When the EGR gas temperature increases and exceeds a predetermined value, e.g. 400° C., the control circuit 13 actuates the motor 12 so that the selection valve 11 is rotated in the direction of an arrow B. Thus, the EGR pipe 15 is connected to the EGR pipe 17, which condition permits the EGR gas to pass through the EGR cooler 6.

As is mentioned above, in the EGR system according to the invention, when the EGR gas temperature is high, the EGR gas is recirculated through the EGR cooler in order to avoid thermal damage to the EGR valve. On the other hand, when the EGR gas temperature is low, the EGR gas is recirculated without passing through the EGR cooler by the operation of the selection valve. Therefore, when the EGR gas temperature is lowered in the light-loaded condition of the engine due to the small amount of EGR gas, overcooling of the EGR gas is avoided, and thereby, the accumulation of carbon and condensation of acid water on the EGR valve and on the EGR pipe are avoided. Thus, the EGR system according to the present invention operates reliably so that $NO_x$ emissions are reduced satisfactorily.

Figure 2:
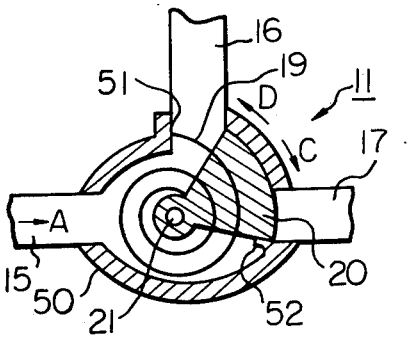
FIG. 2 is a sectional view of an embodiment of a selection valve according to the invention.

In FIG. 2, another embodiment of the selection valve is illustrated. Referring to FIG. 2, stoppers 51, 52 are formed on a valve body 50. A valve 20 is rotatably mounted on a shaft 21 within the valve body 50. A spiral bimetal element 19 is also installed within the valve body 50. One end of the bimetal element 19 engages with the valve 20, while the other end engages with the valve body 50 (in this case, at the stopper 51). When the EGR gas temperature is low, the bimetal element 19 forces the valve 20 to rotate in the direction of an arrow C, so as to close the EGR pipe 17 and to connect the EGR pipe 15 and the by-pass pipe 16. On the other hand, when the EGR gas temperature is high, the bimetal element 19 forces the valve 20 to rotate in the direction of an arrow D, so as to close the by-pass pipe 16 and to connect the EGR pipe 15 and the EGR pipe 17. The amount of deformation of the bimetal element 19 changes in response to the EGR gas temperature, and the changes in deformation change the opening areas of the by-pass pipe 16 and the EGR pipe 17. Thus, the valve 20 is operated so that the EGR gas passing through the by-pass pipe 16 increases proportionately as the EGR gas temperature is lowered.

Figure 3:
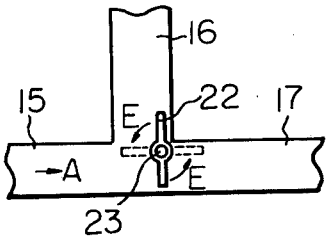
FIG. 3 illustrates another embodiment of the selection valve according to the invention.

Another example of the selection valve is illustrated in FIG. 3. Referring to FIG. 3, a butterfly valve 22 is rotatably mounted on a shaft 23 at the diverging point of the by-pass pipe 16 from the EGR pipes 15 and 17. The shaft 23 is connected to a driving motor (not shown) which is electrically connected to an EGR gas thermosensor (not shown) in the same manner as described in the first embodiment with reference to FIG. 1. When the EGR gas temperature is low, the butterfly valve 22 is maintained at the position shown by a solid line so that the EGR pipe 17 which leads to the EGR cooler is closed; while, when the EGR gas temperature rises, the butterfly valve 22 is rotated in the direction of an arrow E to the position shown by a broken line so that the by-pass pipe 16 is closed and the EGR gas passes through the EGR cooler. The butterfly valve 22 can also be arranged so that it is rotated in the direction of the arrow E by the dynamic pressure of the EGR gas instead of by the driving motor.

The present invention is not limited to the above mentioned embodiments, but can be modified within the scope of appended claims.

What is claimed is:

1. An EGR system in an internal combustion engine comprising:

an EGR pipe which interconnects an exhaust pipe and an intake pipe of the engine;

an EGR valve mounted on said EGR pipe;

an EGR cooler mounted on said EGR pipe upstream of said EGR valve;

a by-pass pipe arranged parallel to said EGR cooler;

a thermosensor which detects the EGR gas temperature; and a selection valve arranged at the connection point of said by-pass pipe to said EGR pipe, said selection valve co-operating with said thermosensor so that when the EGR gas temperature is lower than a predetermined value, the EGR gas passes through said by-pass pipe.

2. An EGR system according to claim 1, wherein said selection valve is of a three-way cock type and actuated by a motor.

3. An EGR system according to claim 1, wherein said selection valve comprises a valve body having three ports and a valve movably arranged within said valve body, said thermosensor being a bimetal element arranged within said valve body so that the bimetal element forces the valve to move in response to the EGR gas temperature.

4. An EGR system according to claim 1, wherein said selection valve is of a butterfly valve type.

* * * * *